United States Patent [19]

Matsuda et al.

[11] Patent Number: 4,488,012

[45] Date of Patent: Dec. 11, 1984

[54] MFB LOUDSPEAKER

[75] Inventors: Norio Matsuda; Yasumitsu Wada; Masaru Chijiiwa, all of Saitama, Japan

[73] Assignee: Pioneer Electronic Corporation, Tokyo, Japan

[21] Appl. No.: 486,780

[22] Filed: Apr. 20, 1983

[30] Foreign Application Priority Data

Apr. 20, 1982 [JP] Japan ..... 57-65997

[51] Int. Cl.[3] ..... H04R 3/08; H04R 23/02

[52] U.S. Cl. ..... 179/115.5 R; 381/96

[58] Field of Search ..... 179/115.5 PV, 115.5 R; 381/96

[56] References Cited

U.S. PATENT DOCUMENTS

| | | | |
|---|---|---|---|
| 2,948,778 | 8/1960 | Clements | 381/96 |
| 3,937,887 | 2/1976 | Miller | 381/96 |
| 3,941,932 | 3/1976 | D'Hoogh | 381/96 |
| 4,139,733 | 2/1979 | Falkenberg | 381/96 |

FOREIGN PATENT DOCUMENTS

| | | | |
|---|---|---|---|
| 2626652 | 6/1976 | Fed. Rep. of Germany | 381/96 |

*Primary Examiner*—Gene Z. Rubinson
*Assistant Examiner*—L. C. Schroeder
*Attorney, Agent, or Firm*—Sughrue, Mion, Zinn, Macpeak & Seas

[57] ABSTRACT

An MFB loudspeaker comprising a detector element mounted on a diaphragm on a specific position, i.e., a nodal line of a primary resonance mode thereof for generating a voltage proportional to a component indicative the vibratory characteristics of the diaphragm.

18 Claims, 21 Drawing Figures

MFB LOUDSPEAKER

BACKGROUND OF THE INVENTION

The present invention relates to an motional feedback loudspeaker, and more particularly to an MFB loudspeaker designed to suppress peaks on frequency characteristics due to resonance of a diaphragm.

MFB loudspeakers are designed to control motions of a vibratory system of the loudspeaker by feeding a voltage proportional to the motions of the vibratory system back to an input of an amplifier serving as a driver of the loudspeaker. The MFB loudspeakers have reduced distortions of the vibratory system and improved sound-pressure vs. frequency characteristics. With this type of loudspeaker, a sufficient MFB effect is available for vibrations at any point while the vibratory system is vibrating in unison at all times. At high frequencies, however, the vibratory system has parts vibrating differently and cannot be controlled with one voice-coil type driver. Therefore, the MFB effect is effectively only in the region in which the vibratory system vibrates in unison.

Various devices for detecting vibrations of the vibratory system are known. They include an acceleration pickup employing a piezoelectric element for detecting the acceleration of the diaphragm, a speed detection coil for the speed, and an electrostatic pickup for detecting the amplitude of vibrations. FIGS. 1 and 2 illustrate a loudspeaker incorporating an acceleration pickup. An acceleration pickup 3 is mounted substantially centrally on a flat diaphragm 2 supported on a baffle 1. The flat diaphragm 2 is supported peripherally by an edge 4 and has a central bobbin 5 with a voice coil wound thereround. The voice coil is positioned in an air gap in a driver unit 6.

The acceleration of vibrations of the flat diaphragm 2 is detected by the acceleration pickup 3, which produces a detected voltage applied through a negative feedback circuit to an input terminal of a loudspeaker driver amplifier.

To position the lead wires from the acceleration pickup or from the standpoint of a detecting position, the pickup is disposed near the voice coil or inside of the bobbin 5. When the loudspeaker is driven, the resonance mode of the flat diaphragm 2 suffers from a high peak at a particular frequency (in the vicinity of 650 Hz) as shown by the solid line in FIG. 3. The peak tends to cause the problem of oscillation when supplying a motional feedback signal to the loudspeaker. For supplying a stable feedback signal, a low-pass filter is employed as a feedback circuit to limit a frequency band to be fed back, or a band-rejection filter is used to reject signals in the corresponding frequency band.

SUMMARY OF THE INVENTION

The present invention provides a loudspeaker designed with no need for a low-pass filter or a band-rejection filter, that is, a loudspeaker which fails to produce a peak in a particular frequency band. To provide such a loudspeaker, the present invention is characterized by the provision of detector elements for detecting acceleration, for example, on node line of the resonance mode of the diaphragm or in the vicinity of the node lines.

DESCRIPTION OF THE PREFERRED EMBODIMENTS

Figure 4:
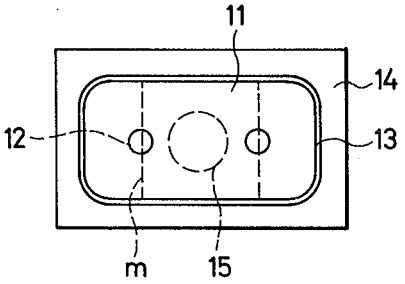
FIG. 4 is a plan view of an MFB loudspeaker according to the present invention.
Figure 5:
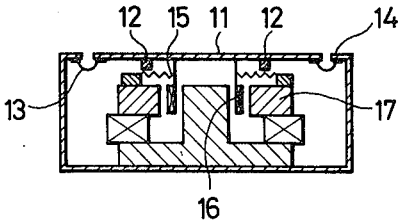
FIG. 5 is a cross-sectional view, shown in side elevation, of the loudspeaker of FIG. 4.

Embodiments of the present invention will be described with reference to the accompanied drawings. FIG. 4 is a plan view of a flat diagram 11 with detector elements 12 fixedly mounted thereon for detecting acceleration. The detector elements 12 are positioned at desired points on node lines m of a primary resonance mode of the flat diaphragm 11. The flat diaphragm 11 is secured peripherally by an edge 13 to a baffle 14. A bobbin 15 has one end affixed to the center of the flat diaphragm 11. A voice coil 16 is wound around the bobbin 15 and positioned in an air gap in a driver unit 17.

Figure 6:
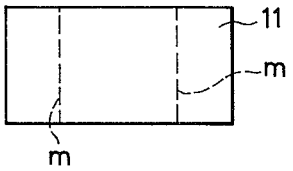
FIGS. 6 and 7 are plan and side elevational views of a diaphragm, illustrative of node lines of a primary resonance mode.
Figure 7:
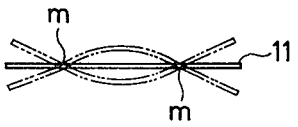
Figure 8:
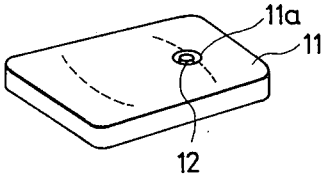
FIG. 8 is a perspective view of a diaphragm to which a detector element is attached.

Since the flat diaphragm 11 of a rectangular shape is given a driving force at its central portion as shown in FIGS. 6 and 7 the node lines m of the primary resonance mode appear as curved lines slightly convex toward longitudinal ends of the diaphragm 11. The detector element 12 is attached along one of the curved node lines. The detector element 12 may be placed in a recess 11*a* defined in the flat diaphragm 11 as illustrated in FIG. 8, or directly fixed to a skin material serving as the flat diaphragm 11.

Figure 9:
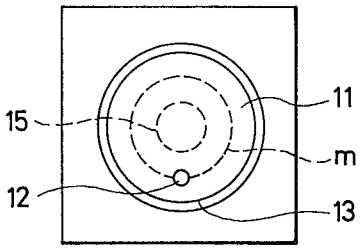
FIG. 9 is a plan view of a loudspeaker having a circular flat diaphragm.

While in the above embodiment the detector element is mounted on the rectangular flat diaphragm, it may be attached to a circular flat diaphragm as illustrated in FIG. 9. With the circular flat diaphragm, a node line of a primary resonance mode extends concentrally with the center of the voice coil. The detector element 12 is a affixed to the diaphragm at a position along the circular node line (FIG. 9).

Figure 10:
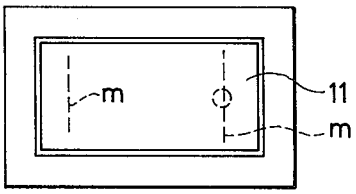
FIG. 10 is a plan view of a loudspeaker having a detector element in the form of a detector coil.
Figure 11:
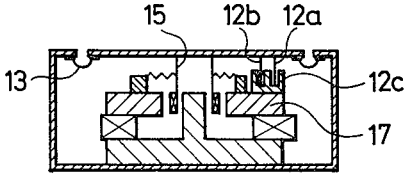
FIG. 11 is a cross-sectional view, shown in side elevation, of the loudspeaker of FIG. 10.

The detector element 12 as described above comprises an acceleration pickup. However, as shown in FIGS. 10 and 11, a bobbin 12*b* with a detector coil 12*a* wound thereon may be fixed to a diaphragm on a node line m of a primary resonance mode with the detector coil 12 being movable up and down in a magnetic circuit 12*c* in a driver unit 17.

Figure 12:
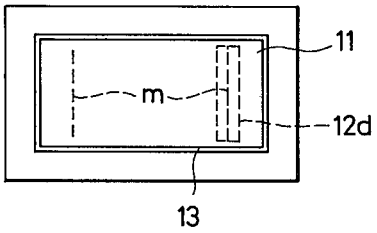
FIG. 12 is a plan view of a loudspeaker having a detector element for detecting a variation in electrostatic capacitance.
Figure 13:
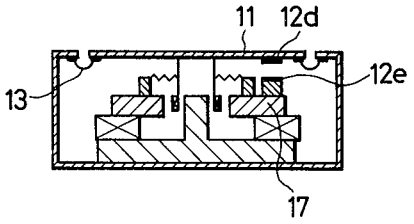
FIG. 13 is a cross-sectional view, shown in side elevation, of the loudspeaker of FIG. 12.
Figure 14:
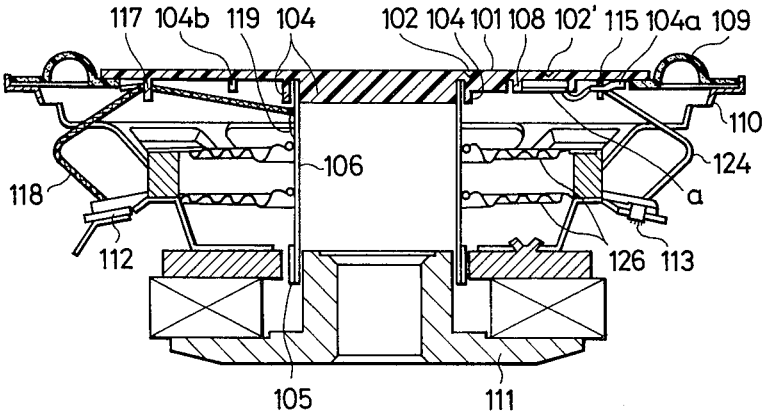
FIG. 14 is a cross-sectional view showing another embodiment of the invention.
Figure 15:
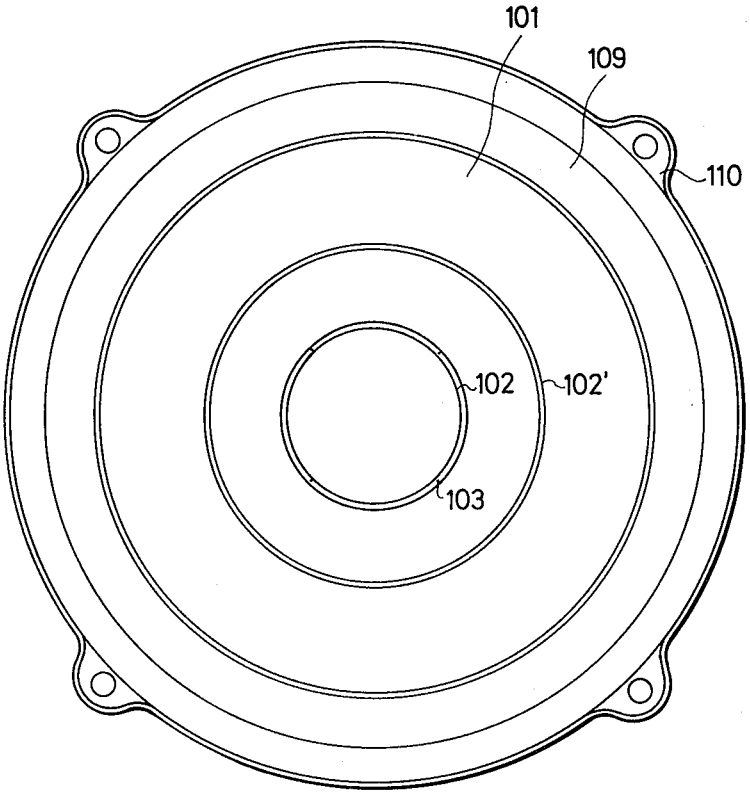
FIG. 15 is a plan view showing the embodiment shown in FIG. 14.
Figure 16:
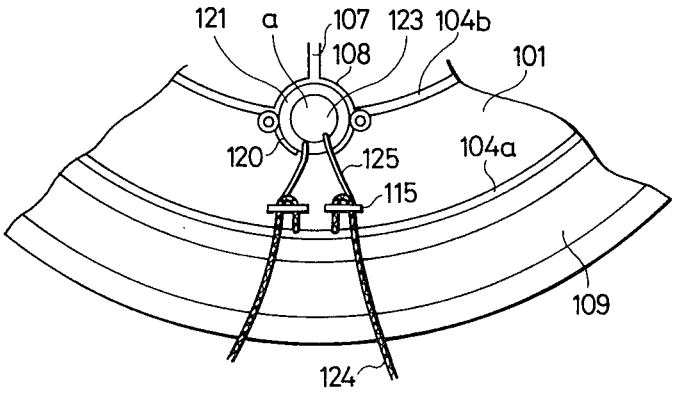
FIG. 16 is a backside view of a pickup unit used in FIG. 14.

A detector for detecting a signal indicative of a variation in electrostatic capacitance may also be employed. In such an embodiment, as illustrated in FIGS. 12 and 13, an electrically conductive member 12*d* is attached to the back of a flat diaphragm 11 along a node line m, and an electrically conductive member 12*e* is attached to a driver unit 17 in confronting relation to the member 12*d*.

Figure 1:
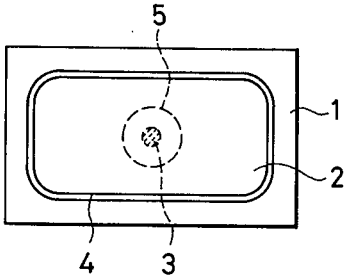
FIG. 1 PRIOR ART
FIG. 1 is a plan view of a conventional MFB loudspeaker.
Figure 2:
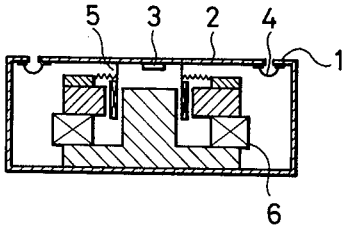
FIG. 2 PRIOR ART
FIG. 2 is a cross-sectional view, shown in side elevation, of the loudspeaker of FIG. 1.
Figure 3:
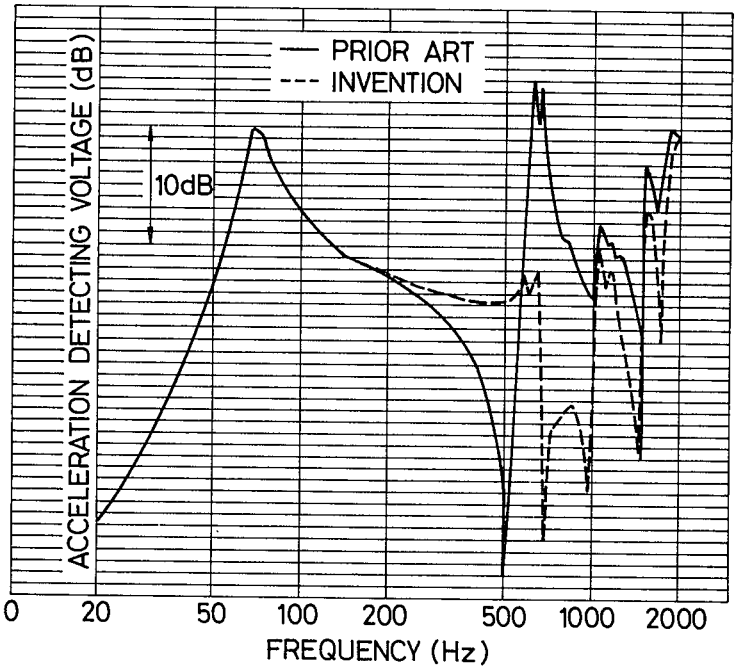
FIG. 3 PRIOR ART
FIG. 3 is a graph showing comparison between detected-voltage vs. frequency characteristics.

When an MFB loudspeakers thus constructed is driven, the peak which has been produced at a frequency (650 Hz) with a prior loudspeaker is eliminated as shown in the dotted-line curve in FIG. 3, which shows detected-voltage vs. frequency characteristic curves of the prior loudspeaker and the loudspeaker of the invention.

It has been found that the farther the detector element 12 is spaced from the node line m of the primary resonance mode, the higher the peak of the detected voltage at a particular frequency.

With the MFB loudspeaker of the present invention, as described above, a detector element for detecting motions of a diaphragm is mounted on the diaphragm on a node line of a primary resonance mode of the diaphragm or in the vicinity of the node line. The detected signal from the detector element is free from a peak at a particular frequency band. Accordingly, a stable feedback signal can be supplied without a band-rejection filter in a feedback circuit. The MFB loudspeaker of the invention is also advantageous in that the feedback signal can have a wider band than possible with a low-pass filter used for removing a peak.

Another embodiment of the present invention will now be described with reference to FIGS. 14 to 21. A circular diaphragm 101 is concentrically provided on its outer surface with annular grooves 102 and 102'. The inner annular groove 102 is provided at its bottom portion with pin gates 103 which are positioned at a same interval on the circumference and which are used in extrusion molding. The reasons why the pin gates 103 are formed in such a manner are that when the flat circular diaphragm 101 is formed of glass fiber reinforced polyethylene terephthalate, the gates are prevented from extending therefrom to the outside to enhance an aesthetic design, that a finishing process therefor is dispensed with, and that a uniform vibration of the flat diaphragm 101 is obtained by eliminating an inner deformation due to non-uniformity in the resin flow from the gates.

The flat diaphragm 101 is centrally provided on its backside with two concentric projections 104. A bobbin 106 wound on a voice coil 105 is inserted at its end into a gap between the projections 104 with adhesives. On the backside of the flat diaphragm 101, an annular projection 104*a* on the peripheral portion thereof, projections 104*b* are formed in the intermediate portion between the projections 104 and 104*a*, three straight projections 107 are formed so as to intersect with the projections 104 and 104*b* and three small annular projections 108 are formed at the respective intersections between the projections 107 and the projections 104*b* in order to make the flat diaphragm 101 balanced.

The flat diaphram 101 is supported at its outer periphery through a foamed urethane 109 by a frame 110. A driver unit 111 is fixedly disposed within an inner portion of the frame 110. The voice coil is positioned in an air gap of the driver unit 111.

Figure 18:
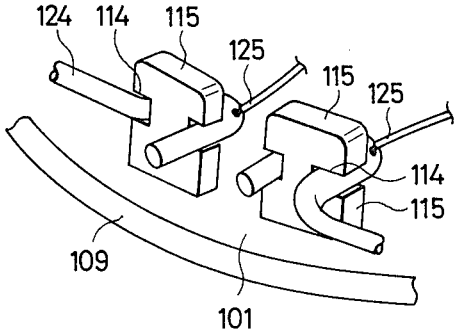
FIGS. 18 and 19 are perspective views showing connections between tinsel cords and lead wires used in the embodiment shown in FIG. 14.
Figure 19:
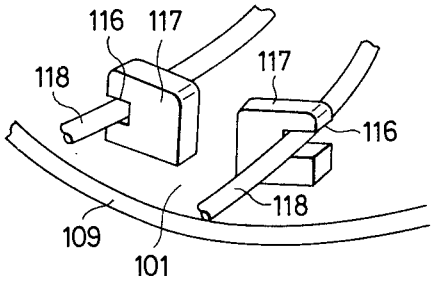

Furthermore, an input terminal 112 and a feedback terminal 113 are formed on the frame 110. A pair of vertically extending walls 115 having cutaway supports 114 on its side face are formed between the outer periphery of the flat diaphram 101 and one of the three small annular projections 108 in the vicinity of the outer periphery of the diaphragm, as shown in FIG. 18 whereas in a diametrically opposite position to the walls 115, another pair of vertically extending walls 117 having cutaway supports 116 on its side face are formed in the vicinity of the outer periphery of the flat diaphragm 101, as shown in FIG. 19. One end of each tinsel cord 118 connected to the input terminal 112 is inserted into the cutaway portion 116 and is fixed thereto with adhesives. Then, the end is drawn while applying a tension thereon and is connected to an end of the lead wire or line 119 by soldering.

Figure 17:
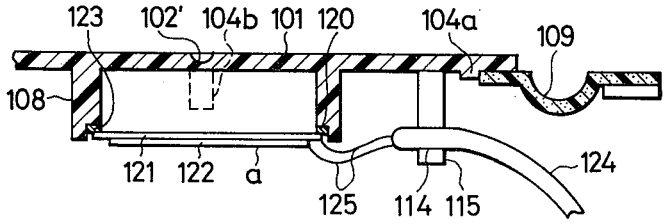
FIG. 17 is an enlarged cross-sectional view showing the pickup unit shown in FIg. 16.

An annular stepped portion 120 is formed in the annular projection 108 which is close to the vertically extending wall 115, as best shown in FIG. 17. A pickup unit a is composed of a plate 121 made of copper or brass and a pickup element 122, such as ceramic or bimorph cell, attached to the plate 121 which is in turn attached to the annular stepped portion 120 with silicone adhesives forming a layer 123. The end of each tinsel cord 124 connected to the feedback terminal 113 is rendered to pass through the cutaway support 114 of the wall 115 and to be connected to the lead line 125 of the pickup unit a by soldering in the same way as in the input terminal connection. Then, the soldered part and the part inserted into the cutaway support 114 are fixed to the wall 115 with adhesives. Between the bobbin 106 of the voice voil 105 and the frame 110 are interposed dampers 126 for dampening vibration of the voice coil 105.

With such a construction, when an output from an amplifier is applied to the input terminal 112, a sound signal current is allowed to flow through the tinsel cords 118 and the lead lines 119 to the voice coil 105 disposed in the air gaps of the driver unit 111. As a result, the voice coil 105 is vibrated up and down. Since the end of the bobbin 106 is fixed to the annular projection 104 of the diaphragm 101, the vibration of the voice coil 105 is transmitted to the diaphragm to thereby vibrate the diaphragm.

In the thus constructed diaphragm 101, since the resin is introduced through the pin gates 108, non-uniformity in resin flow may be avoided to thereby eliminate a possible deformation of the molded diaphragm 101. A secondary vibration of the flat diaphragm 101 may be prevented by the three radial projections 107. The balance of the vibration may be well made by the small annular projections 108. Thus, a desired reciprocative motion of the diaphragm may be ensured.

Since the pickup unit a is provided on one of the small annular projections 108, the pickup unit a is vibrated together with the diaphragm 101. Then, in response to the vibration, voltage is induced by the pickup unit a. The induced voltage is applied through the lead wire 125 and the tinsel cord 124 to the feedback terminal 113, and is fed back to the amplifier to thereby compensate for a difference from the input waveform in the well known manner. This compensation is inputted from the input terminal 112 to thereby reproduce a recorded sound.

However, in the voice coil 105, there is a direct current resistance. Therefore, a part of current flowing through the voice coil is consumed into heat and since a molecular vibration is promoted by the vibration of the flat diaphragm 101, another part of the current is also converted into heat. These heat the pickup unit a per se and its ambient atmosphere.

A thermal expansion coefficient of the glass fiber reinforced polyethylen terephthalate forming the flat diaphragm 101 is about $2.5\times10^{-5}$ cm/cm° C. and a thermal expansion coefficient of the brall or copper plate 121 of the pickup unit a is about $16.5\times10^{-6}$ cm/cm° C. Due to this fact, there will be a difference in expansion, when the pickup unit is heated. If adhesives solidified by heating, or adhesives softened by heating such as rubber system adhesives would be used in the pickup unit a, due to the difference in expansion, the copper or brass plate 121 would be warped or corrugated to be deformed. An undesirable voltage corresponding to this deformation is generated in the pickup unit a. This voltage is also fed back to the amplifier. In this case, it is impossible to reproduce the desired recorded sound. However, according to the invention, adhesives of silicone system which have a desirable flexibility and which are non-solidified property are used to form a layer 123. The above noted difference in expansion is absorbed by deforming the adhesive layer 123. Accordingly, the above described undesirable deformation is not generated in the pickup unit a and a good sound reproduction is ensured.

Figure 21:
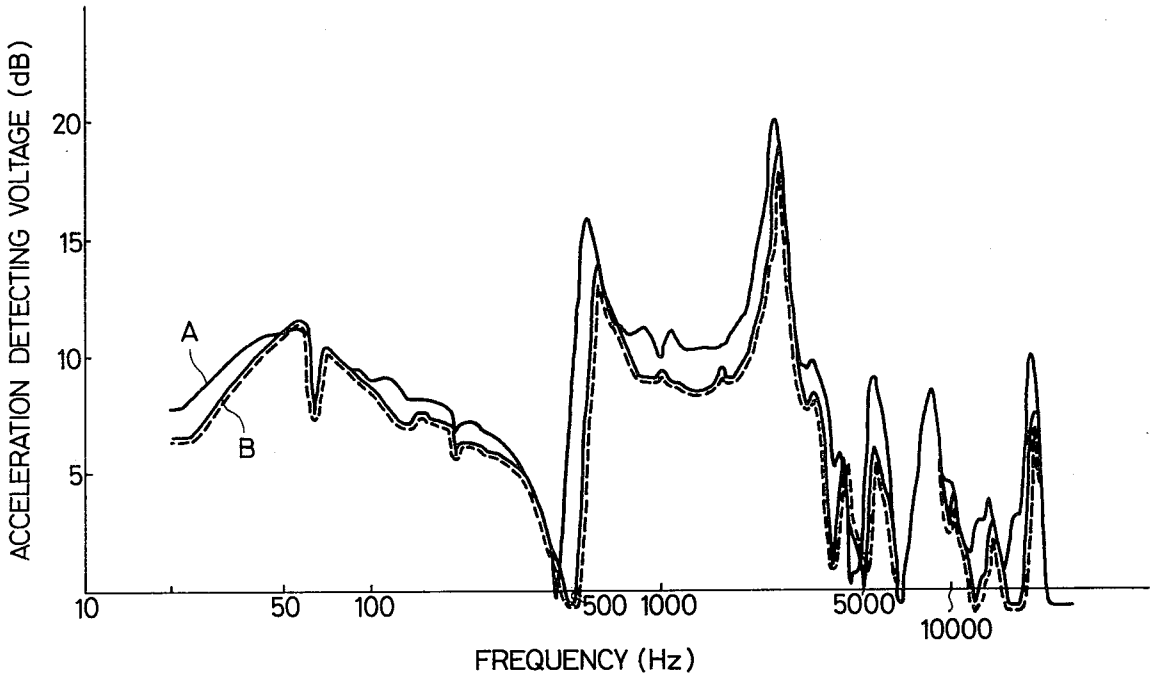
FIGS. 20 and 21 are characteristic diagrams of the prior art and the invention, respectively.
Figure 20:
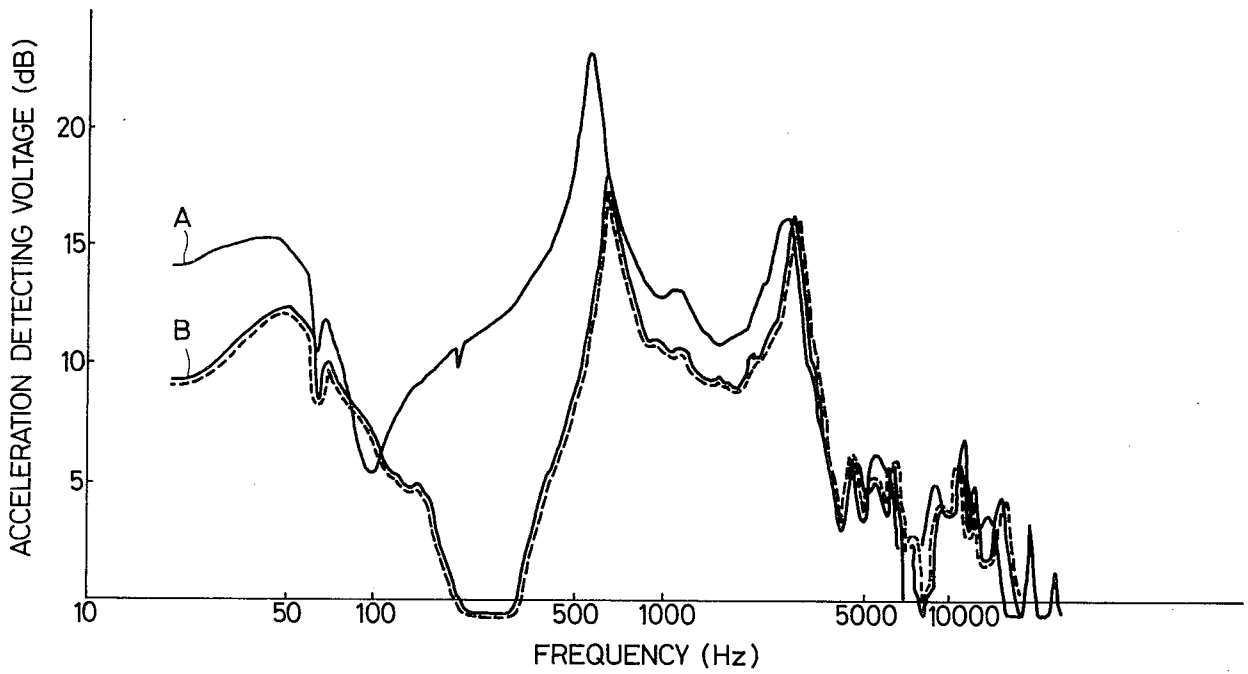

FIGS. 20 and 21 show comparison charts between the case where the conventional rubber adhesives are used in the pickup unit and the case where the silicone adhesives are used in the pickup unit, respectively. In FIGS. 20 and 21, character A represents a frequency characteristics just before the experiment and B, a frequency characteristics when the speaker had been disposed for four hours in a vessel at a temperature of 100° C. FIG. 21 shows the result of the speaker disposed in this condition according to the invention, which was superior to the conventional speaker, because the curves A and B were substantially identical with each other.

According to the invention, since the projection walls 115 and 117 are provided in the vicinity of the peripheral edge of the flat diagraphm 1; the tinsel cords 118 connected to the lead wires 119 and the tinsel cords 124 from the feedback terminal 113 are inserted into the cutaway supports 114 and 116; and after the lead wires 125 from the pickup unit a are soldered, the parts inserted into the cutaway supports 114 and 116 are fastened with adhesives, a process for finishing the end portions of the tinsel cords 118 and 124 and a work of connecting the lead wires 119 and 125 may be facilitated. Since the tinsel cords 118 and 124 are vibrated together with the flat diaphragm 101, there is no fear that undesired noises would be generated upon collision between the tinsel cords and the diaphragm. Since the projection walls 115 and 119 are provided in the vicinity of the edge of the diaphragm 101 and foamed urethane 109 are attached to the peripheral portion of the diaphragm, even if the tinsel cords 118 and 124 would collide against the diaphragm, there would be no noise by the action of the foamed urethane 109.

What is claimed is:

1. A motional feedback loudspeaker comprising:
a diaphragm vibratable for generating reproduced sound, and
means for detecting a vibration of said diaphragm, said means for detecting generating a voltage in proportion to a component indicative of said vibration of said diaphragm, and said means for detecting being mounted on said diaphragm at least in the vicinity of a node line of a primary resonance mode of said diaphragm.

2. The loudspeaker of claim 1, said detecting means being mounted on said node line.

3. The loudspeaker of claim 1, said component including a vibratory acceleration of said diaphragm.

4. The loudspeaker of claim 1, said component including a vibratory velocity of said diaphragm.

5. The loudspeaker of claim 1, said component including a vibratory amplitude of said diaphragm.

6. The loudspeaker of claim 1, said diaphragm being substantially flat.

7. The loudspeaker of claim 1, said diaphragm being substantially in the form of a rectangular shape.

8. The loudspeaker of claim 1, said diaphram being substantially in the form of a circular shape.

9. The loudspeaker of claim 4, further including a driver unit for driving said diaphragm, said detecting means including a detecting coil (12*a*) wound around a bobbin (12*b*) fixed to said diaphragm and a magnetic circuit for driving said detecting coil, said magnetic circuit being mounted on said driver unit.

10. The loudspeaker of claim 5, further including a driver unit for driving said diaphram, said detecting means including a conductive member (12*d*) mounted on a backside of said diaphragm along with said node line thereof and an associated conductive member (12*e*) mounted on said driver unit in confronting relationship with said conductive member (12*d*).

11. The loudspeaker of claim 1, said detecting means comprising a pickup unit (a) including a pickup element (122), and a pickup element support (121) mounted on said diaphragm, and means for attaching said pickup element onto said pickup element support, said attaching means including a non-solidified layer (123) of adhesives having low hardness and flexibility.

12. The loudspeaker of claim 11, said pickup element including a ceramic.

13. The loudspeaker of claim 11, said pickup element including a bimorph cell.

14. The loudspeaker of claim 11, said pickup element support including a copper plate.

15. The loudspeaker of claim 11, said pickup element support including a brass plate.

16. The loudspeaker of claim 11, said adhesives including a silicone adhesive.

17. The loudspeaker of claim 1, said diaphragm including at least one small projecting wall (115, 117) having a cutaway support for holding with adhesives an end portion of a tinsel cord connected to an input terminal of the loudspeaker, said end portion of said tinsel cord being connected to a lead line of a voice coil of said loudspeaker by soldering, said loudspeaker further including a porous sound absorbing member (109) interposed between said diaphram and a peripheral edge of said loudspeaker, said small projection wall being located in the vicinity of an outer periphery of said diaphram.

18. The loudspeaker of claim 1, further including a voice coil, said diaphragm including at least one annular projection wall (104) extending from a backside of said diaphragm, said diaphragm including on its outer surface an annular recess groove within which at least one pin gate for molding is located.

* * * * *